US009275613B2

(12) United States Patent
Borisoff

(10) Patent No.: US 9,275,613 B2
(45) Date of Patent: Mar. 1, 2016

(54) SYSTEM, KIT AND METHOD FOR UNIVERSAL MOUNTING OF TUNING MACHINES ON STRINGED MUSICAL INSTRUMENTS

(71) Applicant: David Joshua Borisoff, Ovid, NY (US)

(72) Inventor: David Joshua Borisoff, Ovid, NY (US)

(73) Assignee: Hipshot Products, Inc., Interlaken, NY (US)

( * ) Notice: Subject to any disclaimer, the term of this patent is extended or adjusted under 35 U.S.C. 154(b) by 0 days.

(21) Appl. No.: 14/431,775

(22) PCT Filed: Sep. 27, 2013

(86) PCT No.: PCT/US2013/062434

§ 371 (c)(1),
(2) Date: Mar. 27, 2015

(87) PCT Pub. No.: WO2014/052910

PCT Pub. Date: Apr. 3, 2014

(65) Prior Publication Data

US 2015/0262561 A1 Sep. 17, 2015

Related U.S. Application Data

(60) Provisional application No. 61/744,518, filed on Sep. 27, 2012, provisional application No. 61/852,536, filed on Mar. 18, 2013.

(51) Int. Cl.
*G10D 3/14* (2006.01)

(52) U.S. Cl.
CPC ..... *G10D 3/14* (2013.01)

(58) Field of Classification Search
CPC ..... G10D 3/14
See application file for complete search history.

(56) References Cited

U.S. PATENT DOCUMENTS 548,475 A 10/1895 Streicher
726,706 A 4/1903 Lang
(Continued)

FOREIGN PATENT DOCUMENTS

DE 359890 C 9/1922
DE 2547662 B1 10/1976
(Continued)

OTHER PUBLICATIONS

International Search Report and Written Opinion in corresponding PCT International Application No. PCT/US2013/062434.

*Primary Examiner* — Robert W Horn
(74) *Attorney, Agent, or Firm* — Lance M. Pritikin, Esq.

(57) ABSTRACT

Systems, kits and methods are provided for mounting multiple tuning machines to a stringed musical instrument without requiring permanent alteration of the instrument. An exemplary mounting element includes a multiplicity of post apertures. Each post aperture is configured to receive a string post of a respective tuning machine, which is then axially secured within respective head stock holes of the instrument. The mounting element includes one or more alignment detents associated with the post apertures. The axial securement generally does not require penetration of the instrument independent of the head stock holes. When the string posts are received by their post apertures and are axially secured to the head stock of the instrument, the alignment detents restrict rotation of the tuner gear housing with respect to the instrument. The axial securement is preferably via threaded engagement between a threaded hub of the tuning machine and a respective barrel nut.

20 Claims, 9 Drawing Sheets

(56) References Cited

U.S. PATENT DOCUMENTS

| | | | | | |
|---|---|---|---|---|---|
| 1,083,736 | A | * | 1/1914 | Glaesel | G10D 3/14 84/306 |
| 1,409,064 | A | | 3/1922 | Richter | |
| 2,104,995 | A | * | 1/1938 | Hutcheson | G10D 3/14 84/306 |
| 2,356,766 | A | | 8/1944 | Kluson | |
| 2,615,360 | A | | 10/1952 | Hawy | |
| 2,960,901 | A | * | 11/1960 | Oopa | G10D 3/14 84/306 |
| 3,564,573 | A | * | 2/1971 | Wustl | G10D 3/14 84/306 |
| 3,982,462 | A | | 9/1976 | Schaller | |
| 4,515,059 | A | | 5/1985 | Siminoff | |
| 4,643,069 | A | * | 2/1987 | Borisoff | G10D 3/14 84/306 |
| 4,840,102 | A | * | 6/1989 | Pittman | G10D 3/14 84/293 |
| 4,860,627 | A | * | 8/1989 | Sloane | G10D 3/14 84/306 |
| 5,180,876 | A | | 1/1993 | Thorward | |
| 5,429,028 | A | | 7/1995 | Fisher, IV | |
| 5,847,295 | A | | 12/1998 | Klepacki | |
| 6,365,809 | B1 | | 4/2002 | Steinberger | |
| 2002/0026864 | A1 | | 3/2002 | Gotoh | |
| 2007/0245878 | A1 | | 10/2007 | Harris | |
| 2015/0262561 | A1 | * | 9/2015 | Borisoff | G10D 3/14 84/312 R |

FOREIGN PATENT DOCUMENTS

| | | | |
|---|---|---|---|
| DE | 102007047540 | B3 | 4/2009 |
| EP | 1351215 | A1 | 10/2003 |
| EP | 1385144 | A1 | 1/2004 |
| JP | S46-22845 | Y | 8/1971 |
| JP | S61-130993 | U | 8/1986 |
| JP | H04-135783 | U | 12/1992 |
| JP | H0511968 | A | 5/1993 |
| WO | 02056291 | A1 | 7/2002 |

* cited by examiner

PRIOR ART

PRIOR ART

SYSTEM, KIT AND METHOD FOR UNIVERSAL MOUNTING OF TUNING MACHINES ON STRINGED MUSICAL INSTRUMENTS

RELATED APPLICATIONS

This application claims the benefit of U.S. Provisional Application No. 61/744,518 filed Sep. 27, 2012, and U.S. Provisional Application No. 61/852,536 filed Mar. 18, 2013 the contents of each of which are incorporated by this reference in their entirety for all purposes as if fully set forth herein.

TECHNICAL FIELD

The present invention relates generally to systems, kits and methods for aligning and mounting tuning mechanisms on stringed instruments. More particularly, the invention relates to systems and methods for adaptively mounting diverse tuning machines in aligned fashion on an instrument without permanently modifying or altering the instrument.

BACKGROUND

Musical instruments, such as acoustic guitars, mandolin and banjos are very popular and have been in mass production for well over 100 years. Other string instruments such as electric guitars and basses have also been produced for over 60 years. Many of these instruments are still in service today. Vintage instruments such as Fender, Gibson and Martin guitars are very coveted and their value can be much greater than those of more modern instruments. As is with many antique and vintage items, value can be impaired if permanent modifications or alterations are performed.

As such instruments age, their tuning machines can wear to the degree that their function and accuracy become impaired. Moreover, tuning machines can break for various reasons, thereby necessitating replacement of the tuning machines even on more modern instruments from time to time. Further, incorporating modern-style tuning machines which possess new and advanced technology would be advantageous to older instruments if the vintage value of the instrument was not affected.

Throughout the years, many different brands and styles of tuning machines have been used on older instruments which can make it very difficult, if not impossible, to find a suitable match. Because different brands and styles of tuning machines require different screw alignment/mounting patterns, it is often necessary to relocate alignment/mounting holes on expensive instruments. Relocating these holes can be difficult. If the alignment/mounting holes are not located precisely, the tuning machine can tilt or be off angle. The alignment/mounting screws tend to be very small while the neck material of instruments can vary from, for example, hard maple to soft mahogany. It is very common for these small screws to strip out or break off in the neck while installing tuning machines. For these and other reasons, many musicians opt to have tuning machines installed by professional instrument technicians, which can be costly.

What is needed is a system, kit and/or method which allows a modern tuning machine to be easily and inexpensively installed on a wide variety of instruments, including vintage guitars, without the need of any permanent alterations to the instrument.

SUMMARY

Certain deficiencies of the prior art may be overcome by the provision of systems, kits and methods for mounting a multiplicity of tuning machines to a stringed musical instrument as described and claimed herein.

An exemplary system for mounting a multiplicity of tuning machines to a stringed musical instrument may comprise at least a mounting element (or what may otherwise be referred to in certain embodiments as a universal mounting plate). The mounting element may include a multiplicity of post apertures. Each of the post apertures is configured to receive a string post of a respective tuning machine. The string posts are then axially secured within respective head stock holes of the instrument. The mounting element preferably includes one or more alignment detents associated with each post aperture. In preferred embodiments, the axial securement does not require penetration of the instrument independent of the head stock holes. When the string posts are received by their post apertures and are axially secured to the head stock of the instrument, the alignment detents substantially prevent rotation of the tuner gear housing (and the corresponding tuning pegs) with respect to the instrument. Typically, the axial securement is by way of threaded engagement between a threaded hub of the tuning machine and a respective barrel nut.

The mounting element may be formed substantially of sheet metal, such as steel. Further, the alignment detents may be protrusions, holes, cavities or some combination thereof. A kit for mounting a multiplicity of tuning machines to a stringed musical instrument may comprise at least one mounting element and a plurality of tuning machines. Methods are discussed herein which provide for the assembly of the kit with a stringed musical instrument.

BRIEF DESCRIPTION OF THE DRAWINGS

Further advantages of the present invention may become apparent to those skilled in the art with the benefit of the following detailed description of the preferred embodiments and upon reference to the accompanying drawings in which.

DETAILED DESCRIPTION OF THE PREFERRED EMBODIMENTS

Figure 1:
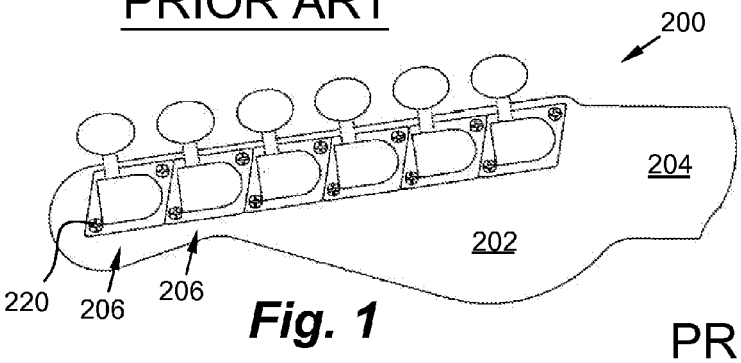
Fig. 1 PRIOR ART
FIG. 1 is a diagrammatic rear view of one prior art system of mounting and aligning tuning machines on a headstock of stringed instrument.

Referring now to the drawings, like reference numerals designate identical or corresponding features throughout the several views.

Embodiments in accordance with the present invention allow someone of average ability to easily replace tuning machines on their instrument. Certain embodiments may offer the customer a "one size fits all" solution for replacing the tuning machines on their instruments. Solutions presented herein allow a variety of modern tuning machines to easily mount to an instrument without requiring drilling, marring or permanent alteration to the instrument of any kind. Construction of components, such as the mounting elements discussed herein, would be lightweight and inexpensive. A set of modern tuning machines possessing the advantages of the latest in technology can now be easily fitted to essentially any stringed instrument.

Figure 2:
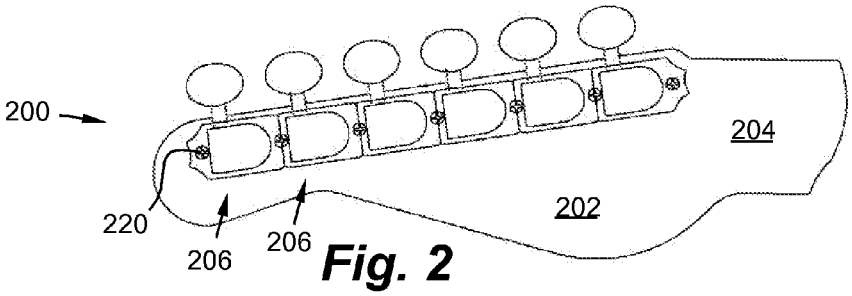
Fig. 2 PRIOR ART
FIG. 2 is a diagrammatic rear view of another prior art system of mounting and aligning tuning machines on a stringed musical instrument.
Figure 3:
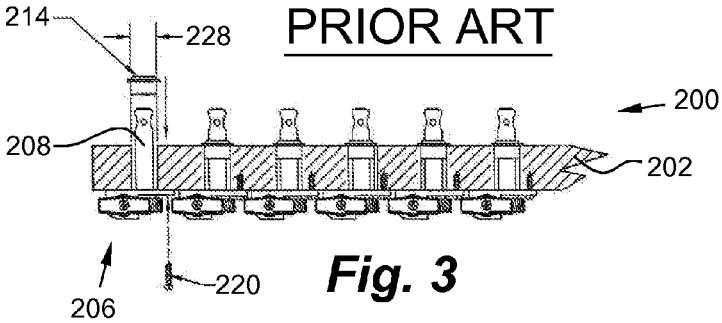
Fig. 3 PRIOR ART
FIG. 3 is a diagrammatic cross-sectional view of a prior art system of mounting and aligning vintage tuning machines on a stringed musical instrument, illustrating the traditional use of a screw to mount the tuning machine to the head stock and prevent rotation of the tuning machine under torque.

Referring to FIG. 1, the back of a typical vintage guitar is shown, with one particular conventional system 200 for mounting tuning machines 206 being illustrated. It should be noted that the tuning machine mounting hole pattern includes two screws 220 per tuning machine 206. Referring to FIG. 2, another typical prior art system 200 used often with vintage style tuning machine configuration is shown. Note that the tuning machines look very different. These tuning machines 206 share mounting screws 220 and the mounting screws are in entirely different locations than in the system illustrated in FIG. 1. FIG. 3 further illustrates the typical way older style or vintage tuning machines mount. The tuners in both FIG. 1 and FIG. 2 are held to the head stock 202 by the mounting screw 220. FIG. 3 depicts a vintage style tuning machine assembly. A push-in bushing 214, often called a ferrule (usually made of brass or steel) guides the string post 208 and keeps it from wearing against the instrument's wooded head stock 202. Note that the diameter of a vintage tuner head stock hole is 8.73 mm, while the contemporary style head stock hole diameter 230 is 10 mm (see FIG. 4). It is contemplated that a specially-designed tuning machine possessing an 8.73 mm threaded hub/barrel nut assembly could be developed for application of the present invention to vintage instruments, as it would be very undesirable to permanently alter a vintage instruments tuning machine hole 226 from 8.73 mm to 10 mm.

Figure 4:
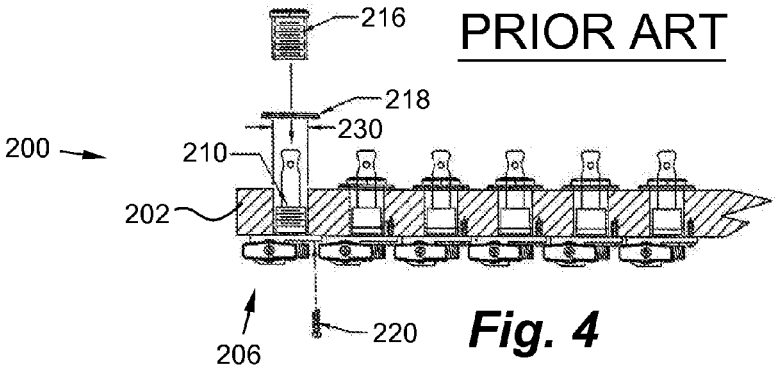
FIG. 4 is a diagrammatic cross-sectional view of a further prior art system of mounting and aligning modern tuning machines on a stringed musical instrument, illustrating the still common reliance on an alignment screw to prevent rotation of the tuning machine under torque.

FIG. 4 shows a top section view of an instrument head stock 202 and the typical fastening method of contemporary (or more modern) tuning machines 206 to an instrument. Note that the string post guide bushing has been replaced by a barrel nut 216 and washer 218. The barrel nut 216 has internal threads which are accepted by external threads located on the tuning machine hub 210. Very often the barrel nut is externally threaded while the hub is internally threaded. The barrel nut 216 fastens the tuner 206 to the instrument while the alignment/mounting screw 220 (or pin 222 in FIG. 5) keeps the tuning machine 206 from rotating due to torque exerted by a tensioned string.

Figure 5:
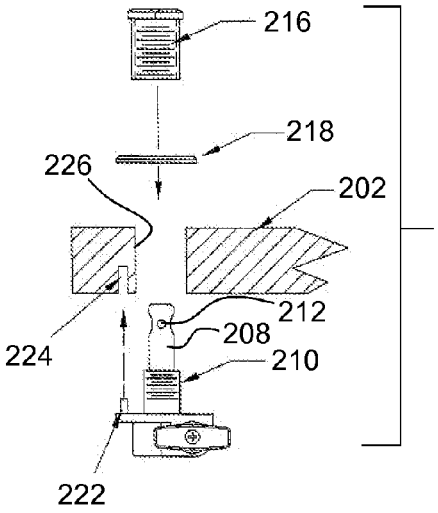
Fig. 5 PRIOR ART
FIG. 5 is a diagrammatic cross-sectional view of yet another prior art system of mounting and aligning tuning machines on a stringed musical instrument, illustrating the alternative conventional use of an alignment pin to prevent rotation of the tuning machine under torque.

FIG. 5 is a partial top section view of a head stock 202 of a guitar showing a different style tuning machine. This tuning machine does not use an alignment/mounting screw, but fastens to the instrument using the barrel nut 216 method. An alignment pin 222, which is received by the instrument in a corresponding alignment hole 224 located in the rear side of the head stock 202 keeps the tuning machine from rotating due to torque exerted by a tensioned string.

Figure 6:
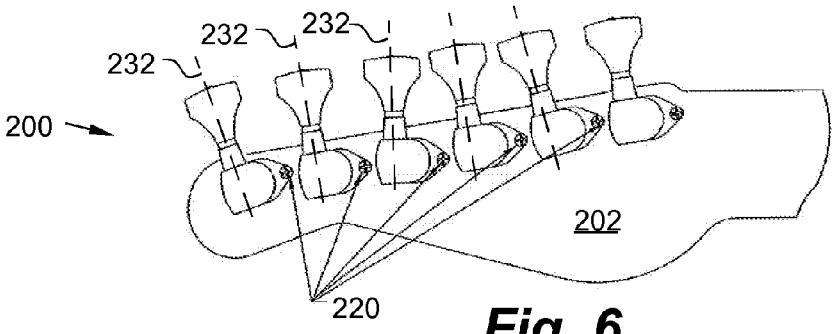
Fig. 6 PRIOR ART
FIG. 6 is a diagrammatic rear view of a stringed instrument illustrating the result of poorly-placed alignment/mounting screws.

FIG. 6 depicts a set of tuning machines which have been incorrectly fastened to a guitar. In this case, we can see that the shaft axes 232 are not aligned with one another. If the alignment/mounting screws 220 (or pins) are misaligned even a degree or two, an unsightly and unprofessional appearance can result which could detract from the value of the instrument.

Figure 7:
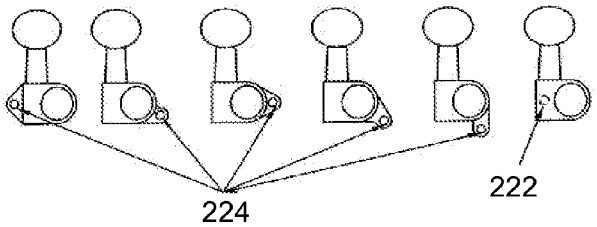
FIG. 7 illustrates examples of different makes and models of conventional tuning machines, which often feature varying alignment screw/pin locations.

FIG. 7 shows some of the many different tuning machines available on the market today. Please note that the holes 224 for the small alignment/mounting screws vary in location with respect to the remainder of the tuning machine. This would require different mounting hole patterns to be located in the neck of an instrument if the various tuning machines were interchanged on the same instrument. Because there are so many different models and types of tuning machines used on the various instruments, replacing tuning machines is made more difficult.

Figure 8A:
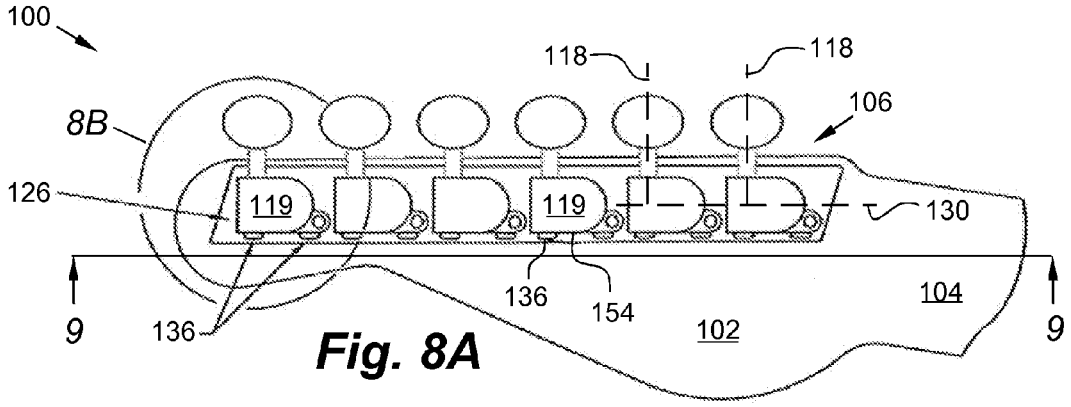
FIG. 8A is a diagrammatic rear view of a mounting system in accordance with certain embodiments of the present invention.

FIG. 8 illustrates a system in accordance with the present invention. Note that the mounting element (or "plate") 126 is secured to the instrument using the tuning machine's barrel nuts only. It does not use the small mounting alignment screws or pins commonly relied on in the prior art. The alignment of the mounting element is determined by the mounting position of at least two tuning machines 106. In particular preferred embodiments, each tuning machine 106 is aligned and is kept from pivoting by the mounting element's two small alignment tabs 136 per tuner.

Figure 8B:
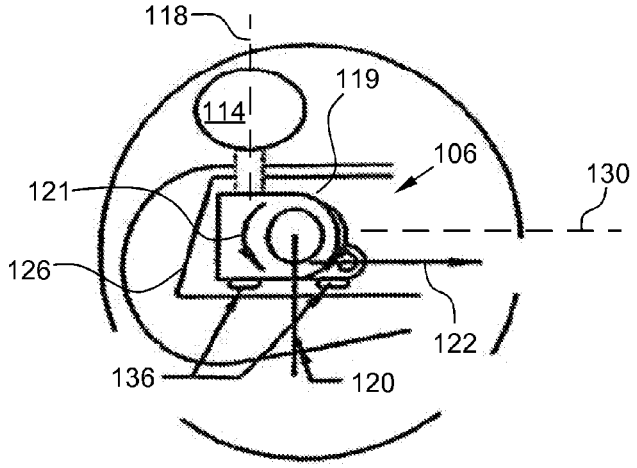
FIG. 8B is a diagrammatic magnified view of feature 8B in FIG. 8A.

Referring to FIG. 8B, In certain embodiments, there is one alignment tab 136 provided on the left side of the center of rotation 120 of the tuning machine 106 while another alignment tab 136 is on the right side of the center of rotation 120 of the tuning machine 106. The two alignment tabs 136 (which represent one possible embodiment of what may be more broadly referred to herein as alignment detents) ensure that the position of the tuning machine is stabilized when a torque 121 is applied by way of a tensioned string force (e.g., in direction 122). One long alignment tab which spans the distance of both sides of the center of rotation could also work.

Figure 9:
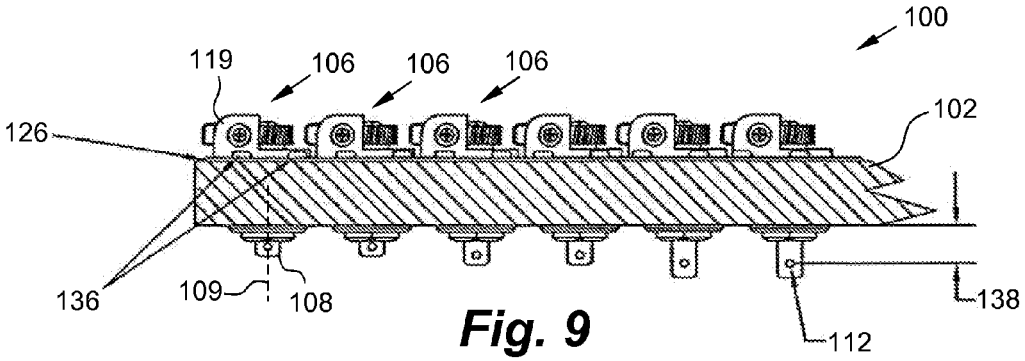
FIG. 9 is a diagrammatic cross-sectional view taken along line 9-9 in FIG. 8A.

FIG. 9 illustrates a kit or system 100 in which the mounting element 126 provides two alignment tabs 136 per tuner. Note that, in preferred embodiments, the mounting element 126 is located between the head stock 102 (e.g., on a neck 104) and the tuning machines 106. As a result, in such embodiments, the tuning machines 106 are shimmed away from the neck the thickness of the mounting element 126. Because the tuning machine's string attachment point (or "post hole") 112 is critical for proper function of the guitar, and because this distance 138 can be altered by the thickness of the mounting element, it is important that the mounting element be as thin as possible. Alternatively, the thickness of the mounting element can be taken into consideration when designing tuning machines specifically for implementation with mounting element.

Figure 10:
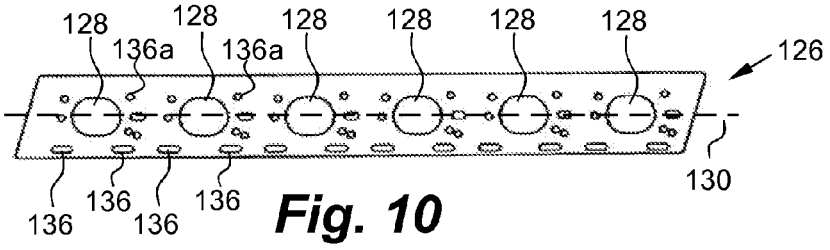
FIG. 10 is a diagrammatic plan view of a mounting element in accordance with one embodiment of the present invention, this one being equipped with many different alignment detents (mounting features) configured to accommodate a wide variety of tuning machines.

The specific design of the mounting element 126 is adaptable for different types of instruments including electric and acoustic guitars, electric basses, banjos, mandolins, etc. For example, the most popular configuration for electric guitar might be be a six in-line mounting plate 126 for Fender Stratocaster® or Telecaster® type guitars. This standard Fender® tuning machine hole placement dimension, established in the early 1950s is $^{11}/_{32}$" from center to center of adjacent tuning machines (or $4^{11}/_{16}$" from center to center of the outside tuning machines). As illustrated in FIG. 10, the apertures 128 of the mounting element 126 can be elongated to accommodate slight variations in these dimensions which may be present in different manufacturer's guitars.

Figure 11:
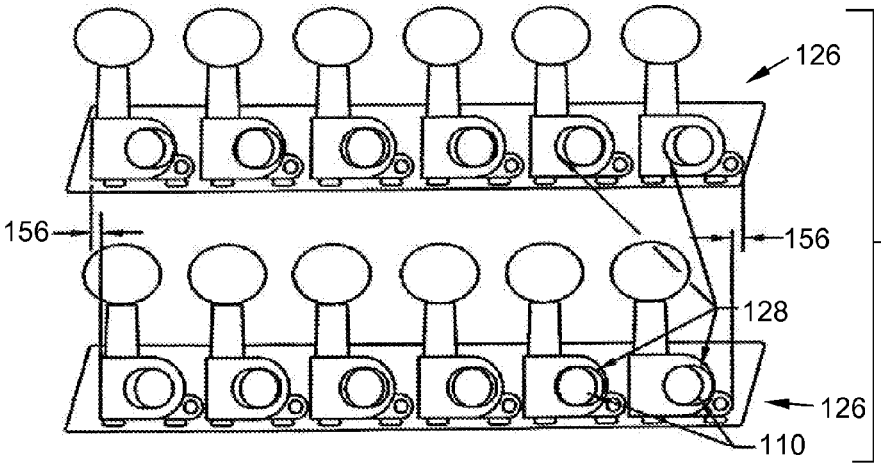
FIG. 11 is a diagrammatic rear view of two implementations of an embodiment of the present invention, showing how a single mounting plate can accommodate variations in tuning machine spacing by way of elongated apertures.

Referring to FIGS. 10 and 11 for illustration, a mounting element 126 in accordance with the present invention can be manufactured so that it possesses all (or most) of the mounting patterns and features to accommodate popular tuning machines. It may also allow for adjustable distances 156 to accommodate various positions of the hubs 110 with respect to the corresponding apertures 128. These features may include threaded and non-threaded holes, slots, tabs, protrusion, etc. However, as illustrated in FIG. 11 for example, it may be preferred to manufacture the mounting element to have one pattern or set of features so that one specific tuning machine can be easily mounted to the widest variety of instruments.

Figure 12:
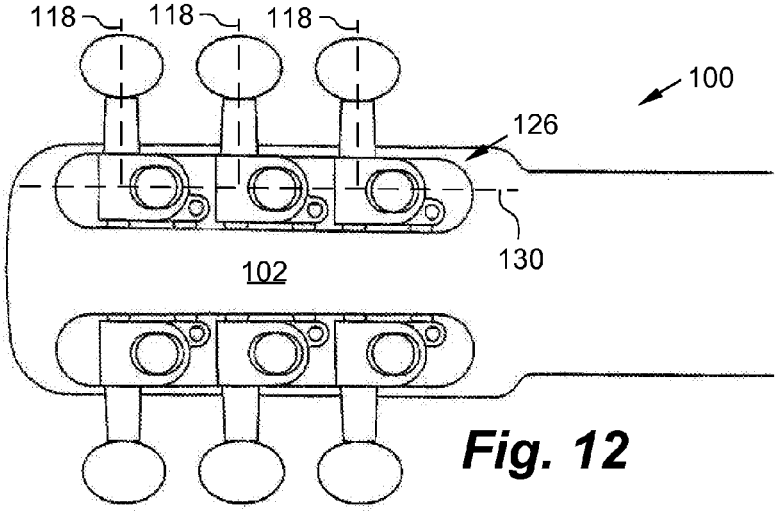
FIG. 12 is a diagrammatic rear view of a system in accordance with one embodiment of the present invention, wherein a mounting element may comprise three apertures and associated alignment detents (alignment tabs in this case)

Not only can a mounting element in accordance with the present invention be used in a six-tuner in-line application as is common with Fender® and Fender®-style instruments, it can also be used with instruments with the conventional three-tuners-per-side configuration such as is common with acoustic guitars and Gibson® style instruments (see, for illustration, FIG. 12). Embodiments of the mounting element 126 can be adapted to work for a two-on-a-side tuner configuration as is common with banjo and Ukulele instruments.

Figure 13:
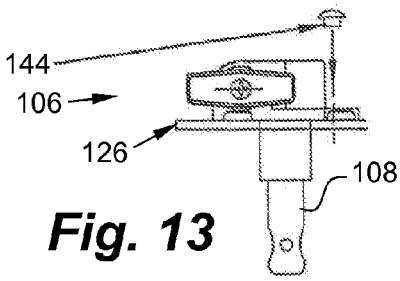
FIG. 13 is a diagrammatic side view of a modern tuning machine, for which certain embodiments of the present invention may provide a plug or button (for example, plastic) to close the hole originally intended to receive a mounting/alignment screw.

As illustrated for example in FIG. 13, since systems in accordance with the present invention preferably do not require an alignment/mount screw, a plug 144 (plastic or metal, for example) can be pressed into the tuning machine's empty alignment screw socket to finish off its appearance.

Figure 14A:
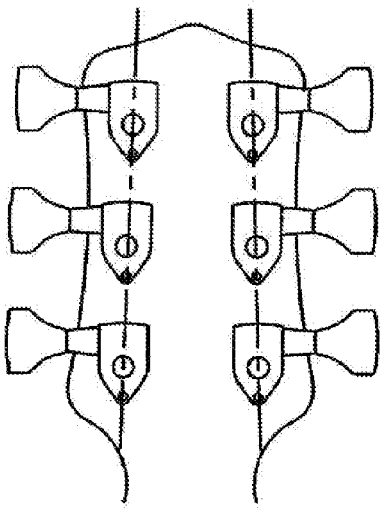
FIG. 14A is a diagrammatic rear view of a first tuning machine layout.
Figure 14B:
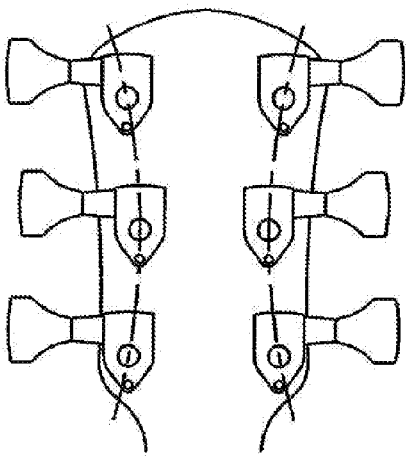
FIG. 14B is a diagrammatic rear view of a second tuning machine layout.
Figure 14C:
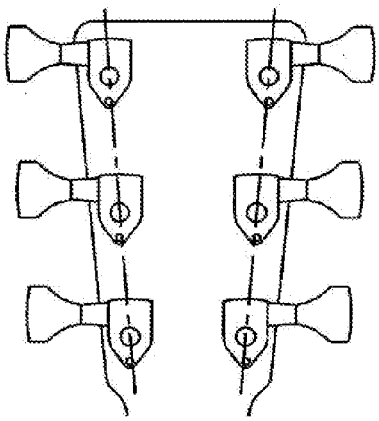
FIG. 14C is a diagrammatic rear view of a third tuning machine layout.

As there are many different makes, models and styles of guitars which use the three-on-a-side tuning machine configuration, additional features can be incorporated to make embodiments of the mounting element more flexible. By way of example, referring to FIGS. 15A through 15C for example, incorporating an articulated link (e.g., "auxiliary mounting element" or "pivot plate") 127 allows certain systems and kits in accordance with the present invention to be adaptive to many more guitar tuning machine layout configurations (e.g., by pivoting in direction 134). While guitars generally have three tuning machines on each side of their head stock, the position of the tuning machines vary greatly as can be seen, for example, in FIGS. 14A through 14C.

Figure 16:
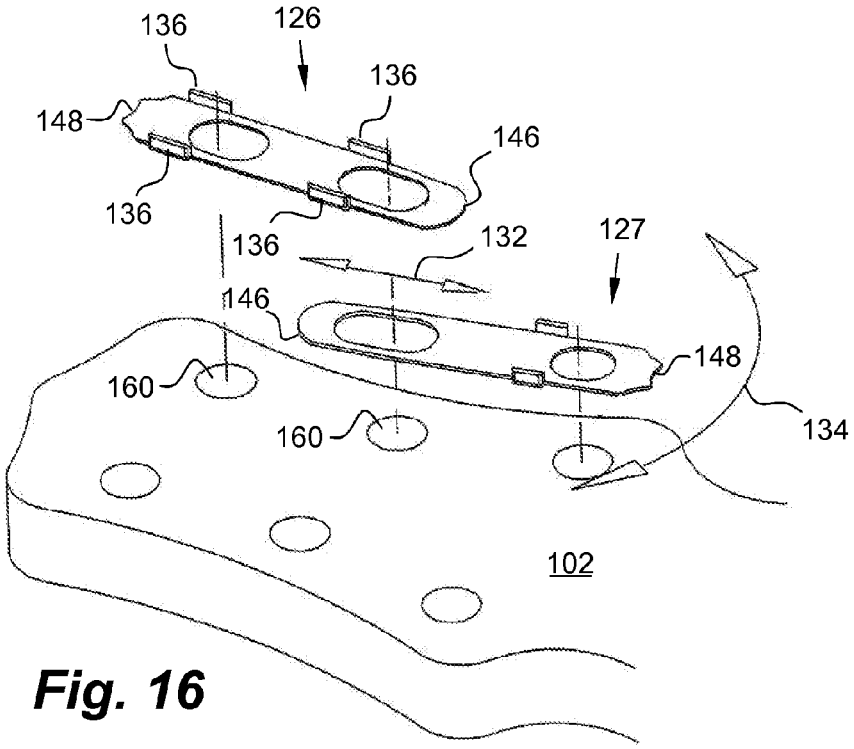
FIG. 16 is a diagrammatic perspective view of a primary mounting element and auxiliary mounting element being pivotally and axially configured for use in association with a particular curved hole pattern.
Figure 17:
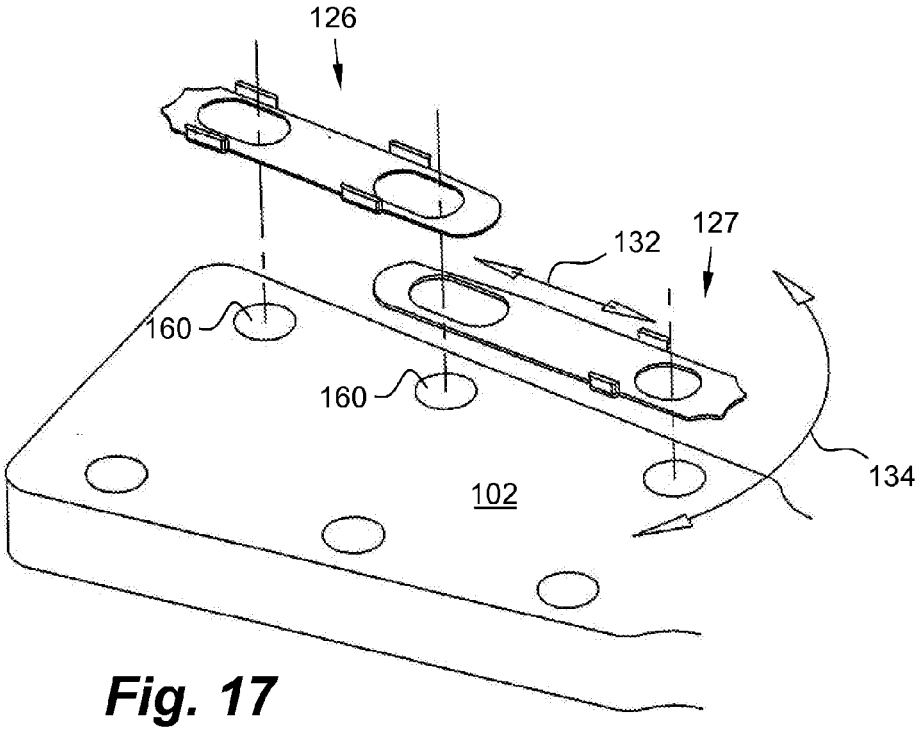
FIG. 17 is a diagrammatic perspective view of a primary mounting element and auxiliary mounting element being pivotally and axially configured for use in association with a specific linear hole pattern.

The pivot plate 127 would allow embodiments to reach tuning machine positions that are out of line from each other. Referring to FIGS. 16 and 17, for example, embodiments of the pivot plate may be slotted so that they can be expanded or contracted (e.g., in axial direction 132) with respect to the primary mounting element 126 to accommodate different tuning machine layouts at various angles and distances. The pivot plate 127 overlaps the stationary plate 126. In this configuration, the stationary plate 126 may have two receiving tab sections to receive two tuning machines and pivot plate may have one tab section to receive a single tuning machine. The material of the mounting elements is preferably thin enough so that the doubling up of the plate thickness is not relevant to the function of the system. Referring to FIG. 15C, the overlapping sections of the plates can have a slight tapered shape so that as the pivot plate 127 is rotated against the stationary plate 126, the overall width of the combined plates do not substantially increase.

Figure 18:
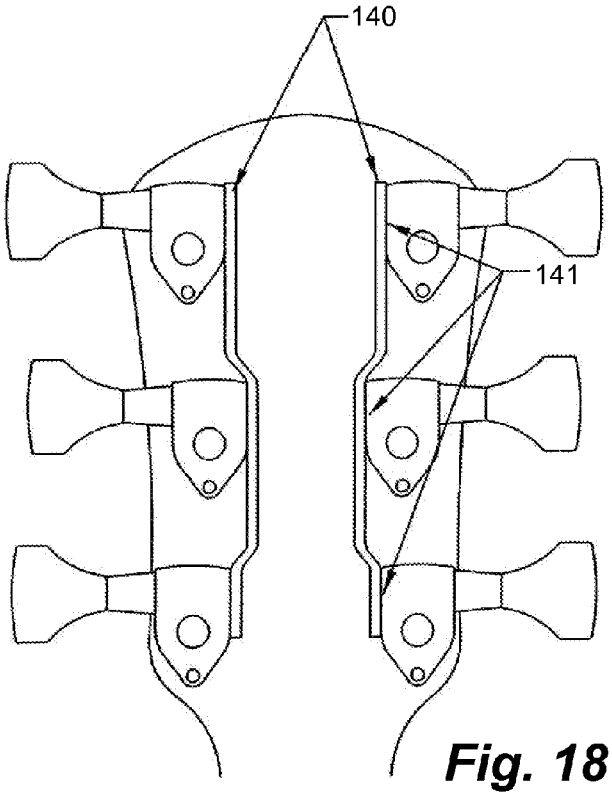
FIG. 18 is a diagrammatic rear view of an alternative embodiment of a tuning machine mounting system, wherein semi-flexible members link the tuning machines to one another on non-rotatable fashion.

Referring to FIG. 18 for illustration, in an alternative embodiment consistent with the spirit of the invention, tuning machines could be linked by semi-flexible material 140 at attachment points 141. This material could be, for example, a piece of wire or thin metal. The material would preferably be flexible enough to be purposely bent by the installer using pliers, but stiff enough to retain its shape against the pressure exerted by the rotational motion of the tuning machines as the string pull exerts its force against them.

Figure 19:
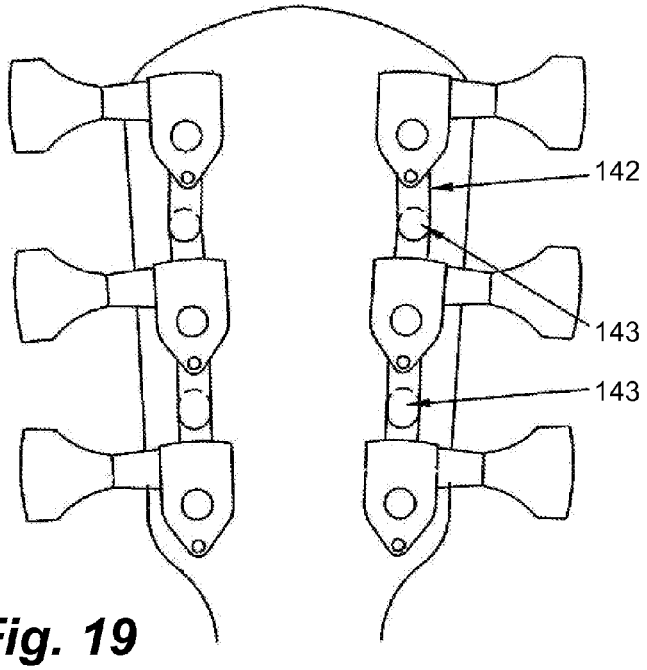
FIG. 19 is a diagrammatic rear view of yet another alternative embodiment of a mounting system, wherein arms extend between tuning machines and link to one another at connection points.

Referring to FIG. 19 for illustration, in another adaptation of the invention could involve individual members which would install independently but link to each other through a series of interlinking "arms or hands" 142. These interlinking arms or hands would "reach out" and secure to each other at connection points 143, thus stabilizing each other's rotational position.

Figure 20:
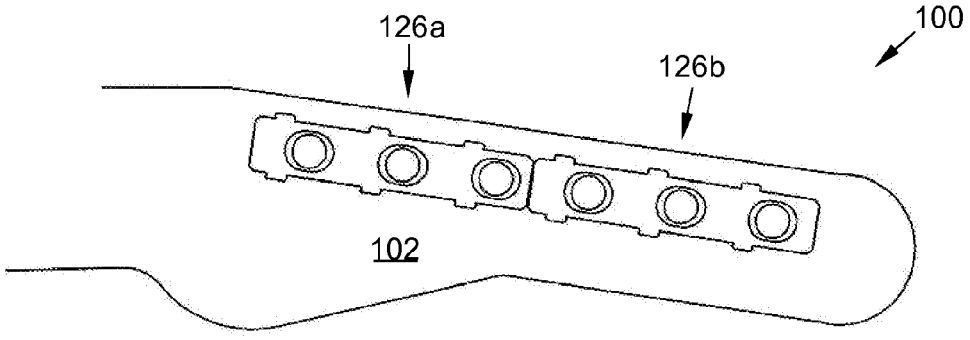
FIG. 20 is a diagrammatic rear view of an example embodiment comprising first and second mounting elements, wherein the proximate ends of the mounting elements abut one another to help provide proper alignment with the holes in the head stock.
Figure 21:
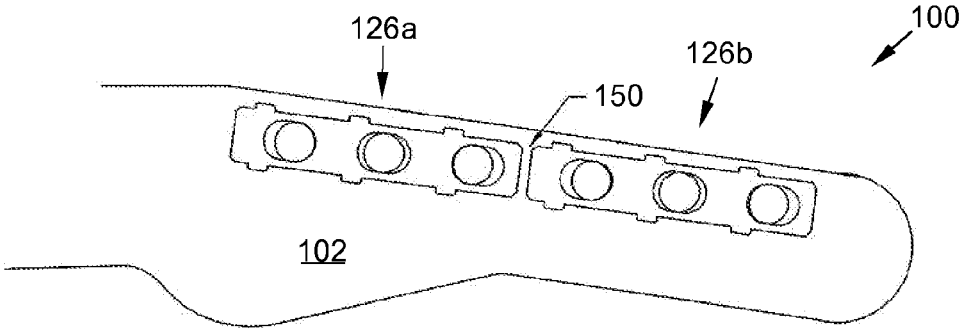
FIG. 21 is a diagrammatic rear view of an example embodiment comprising first and second mounting elements, wherein the proximate ends of the mounting elements are spaced apart from one another to help provide proper alignment with the holes in the head stock.
Figure 22:
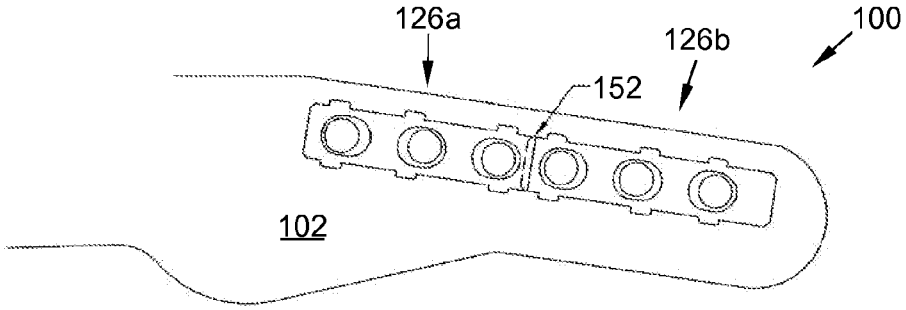
FIG. 22 is a diagrammatic rear view of an example embodiment comprising first and second mounting elements, wherein the proximate ends are each tapered at an angle generally complimentary to the other in order to overlap and help provide proper alignment with the holes in the head stock.

Fender® guitars use a six in line tuning machine head stock configuration which is 4 11/16" center-to-center distance from the center of the first tuning machine to the center of sixth tuning machine. This configuration is quite common in the art and therefore is expected to make a respective adaptation of the present invention very popular. While most instruments adhere to this standard distance, there are a significant number of guitar which either use a wider or narrower spacing. Even though preferred embodiments of the present invention use slots to compensate for minor variations, it may be advantageous for the mounting element to be divided into shorter sections. For example, FIG. 20 shows a first mounting element 126*a* and a second mounting element 126*b* spanning three tuning machines each. The distance between the first and second mounting elements can be varied to accommodate the different tuning machine spacing used by various guitars. FIG. 21 illustrates a six in line guitar with an expanded tuning machine configuration. Note that the mounting elements (126*a* and 126*b*) are spaced out 150 to accommodate the increased distance between the tuning machines. FIG. 22 depicts a six in line tuning machine configuration with a compressed or decreased tuning machine configuration. Note that the two-piece mounting element can be cut shorter or overlapped to accommodate the decreased distance.

Referring again to FIG. 8A, a system 100 for mounting a multiplicity of tuning machines 106 to a stringed musical instrument may comprise a primary mounting element 126. The primary mounting element 126 may include a multiplicity of post apertures 128 (see, for example, FIG. 10). Each post aperture 128 may be configured to receive a string post 108 of a respective tuning machine (see FIG. 13) therethrough when the string posts 108 are in axial securement in respective head stock holes 160 of the instrument (see, for example, FIG. 17). The primary mounting element 126 may include one or more alignment detents 136 associated with each post aperture 128 (see, for example, FIG. 10). In preferred embodiments, the axial securement does not require penetration of (e.g., drilling, threading into, etc.) the instrument independent (e.g., outward of) of the head stock holes 160. Referring to FIG. 8B for example, each tuning machine 106 typically includes a tuning knob 114 disposed along a shaft axis 118. When the string posts are received by their post apertures and are in their axial securement, the alignment detents 136 are engaged by detent engaging portions of the gear housing (see, for example, gear housing distal side 154) substantially prevent movement of the respective shaft axes 118 with respect to the instrument.

In particular embodiments of a system 100, the axial securement may be by way of threaded engagement between a threaded hub 210 of the tuning machine and a respective barrel nut 216 (see FIG. 4, for example). In certain embodiments of a system 100, the shaft axes 118 (e.g., of the shafts 116) are parallel to one another when the string posts 108 are received by their post apertures 128 and are in their axial securement. Referring to FIG. 12 for illustration, the mounting element 126 may include a mount axis 130 along which the post apertures 128 are distributed. Is such embodiments, the shaft axes 118 may preferably be perpendicular to the mount axis 130 when the string posts are received by their post apertures 128 and are in their aforementioned axial securement. In embodiments, the mounting elements may be formed substantially of sheet metal.

Figure 15A:
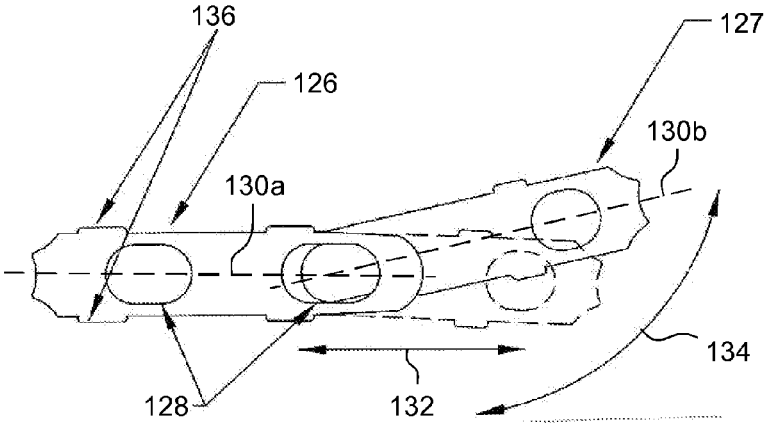
FIG. 15A is a diagrammatic plan view of an embodiment of a system which includes a primary mounting element and an auxiliary mounting element which can pivot and axially extend with respect to one another to accommodate various hole patterns and tuning machine layouts like the ones illustrated, for example, in FIGS. 14A through 14C.
Figure 15B:
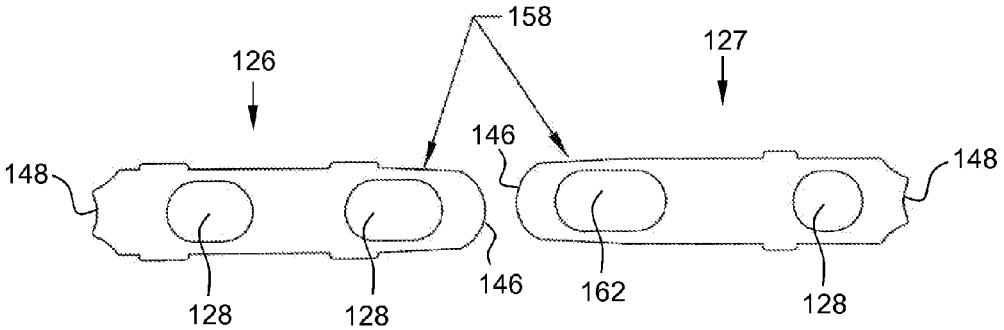
FIG. 15B is a diagrammatic plan view of the embodiment of FIG. 15A, but shown with the mounting elements separated to illustrate the lateral tapering at their proximal ends.
Figure 15C:
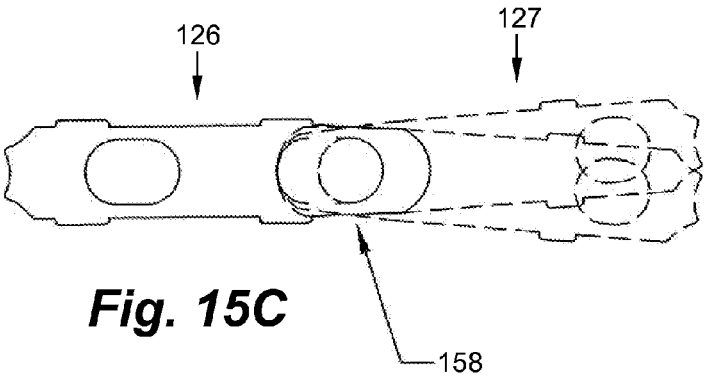
FIG. 15C is a diagrammatic plan view similar to that of FIG. 15A, illustrating the relative lack of lateral expansion at the joint where mutual rotation takes place.

Referring to FIGS. 15A through 15C, in particular embodiments, a system 100 may comprise an auxiliary mounting element 127 including an auxiliary mount axis 130*b*, at least one post aperture 128 and an adaptor aperture 162. The primary mounting element 126 in such embodiments may have a primary mount axis 130*a*. The adaptor aperture 162 is preferably configured to at least partially axially align with one of the post apertures 128 of the primary mounting element 126 when the string posts 108 are received by their post apertures 128 and are in their axial securement. In embodiments, the adaptor aperture 162 may preferably be elongated. Further, the primary and auxiliary mounting elements my each have a respective proximal end 146 and distal end 148. Referring to reference character 158 in FIG. 15B, the primary and auxiliary mounting elements may be laterally tapered toward their proximal ends 146. The adaptor aperture 162 of the auxiliary mounting element 127 is typically closer to its respective proximal end 146 than its respective distal end 148.

Referring to FIGS. 20 through 22 for illustration, certain embodiments may comprise a first and second primary mounting plate (126*a* and 126*b*, respectively). In particular such embodiments, each mounting element may include at least two post apertures and a proximate end, the proximate ends each overlapping one another, for example, by being tapered at an angle generally complimentary to the other (see reference character 152, for example).

Referring again to FIG. 10, in particular embodiments, the alignment detents 136 are protrusions (e.g., tabs extending outward from the flat base of the mounting element). Alternatively, the alignment detents may be one or more holes or cavities 136*a* in the mounting element 126. In further alternative, two or more of the post apertures 128 may share the same alignment detent (e.g., where a single tab, or the like, extends across the length of the mounting element).

Particular systems 100 may comprise a mounting element 126 including a multiplicity of post apertures 128 and at least one alignment detent 136 associated with each post aperture 128. The mounting element 126 may be adapted to being placed in an assembled configuration with the instrument and a plurality of tuning machines 106. In the assembled configuration of certain such embodiments, a string post 108 of each tuning machine 106 extends through a respective one of the post apertures 128 and a respective head stock hole 160 in the instrument, each string post is axially secured in its respective head stock hole without requiring penetration of the instrument independent of the head stock hole, and the alignment detents substantially prevent rotational movement of a gear housing of each respective tuning machine with respect to the instrument.

A kit for mounting a multiplicity of tuning machines 106 to a stringed musical instrument may comprise a mounting element 126 and a plurality of tuning machines 106. The mounting element 126 may include a multiplicity of post apertures 128 and at least one alignment detent associated with each post aperture. Each tuning machine 106 may have a string post 108 and a gear housing 119. Each string post 108 defines a post axis 109 (see FIG. 9). In such embodiments, the mounting element 126 may be adapted to being placed in an assembled configuration with the instrument and the tuning machines. In such a configuration: a string post 108 of each tuning machine 106 extends through a respective one of the post apertures 128 and a respective head stock hole 160 in the instrument; each string post 108 is axially secured in its respective head stock hole 160 without requiring penetration of the instrument independent of (e.g., outside or away from) the head stock hole 160; and the alignment detents 136 substantially prevent rotational movement of each respective gear housing 119 about its post axis with respect to the instrument.

A method for mounting a multiplicity of tuning machines to a stringed musical instrument, the method comprising the steps of: selecting a mounting element including a multiplicity of post apertures and at least one alignment detent associated with each post aperture; providing a plurality of tuning machines, each tuning machine having a string post and a gear housing, each string post defining a post axis; inserting the post apertures of each tuning machine through a respective post aperture and a respective head stock hole in the instrument; and threadedly axially securing each string post in its respective head stock hole with the alignment detents engaging the respective gear housings and thereby substantially preventing rotational movement of the gear housings about their post axes with respect to the instrument. In preferred such methods, neither the axial securement nor the prevention of rotational movement requires permanent alteration of the instrument from its originally-manufactured form.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A system for mounting a multiplicity of tuning machines to a stringed musical instrument, the system comprising:

a primary mounting element including a multiplicity of post apertures, each post aperture being configured to receive a string post of a respective tuning machine therethrough when the string posts are in axial securement in respective head stock holes of the instrument, the primary mounting element including one or more alignment detents associated with each post aperture;

wherein, (a) the axial securement does not require penetration of the instrument independent of the head stock holes;

(b) each tuning machine includes a tuning knob disposed along a shaft axis; and (c) when the string posts are received by their post apertures and are in their axial securement, the alignment detents substantially prevent movement of the respective shaft axes with respect to the instrument.

2. A system as defined in claim 1 wherein the axial securement is by way of threaded engagement between a threaded hub of the tuning machine and a respective barrel nut.

3. A system as defined in claim 1 wherein the shaft axes are parallel to one another when the string posts are received by their post apertures and are in their axial securement.

4. A system as defined in claim 3 wherein:

the mounting element includes a mount axis along which the post apertures are distributed; and the shaft axes are perpendicular to the mount axis when the string posts are received by their post apertures and are in their axial securement.

5. A system as defined in claim 1 wherein the primary mounting element is formed substantially of sheet metal.

6. A system as defined in claim 1 further comprising an auxiliary mounting element including at least one post aperture and an adaptor aperture, the adaptor aperture being configured to at least partially axially align with one of the post apertures of the primary mounting element when the string posts are received by their post apertures and are in their axial securement.

7. A system as defined in claim 6 wherein the adaptor aperture is elongated.

8. A system as defined in claim 6 wherein the primary and auxiliary mounting elements each have a respective proximal end and distal end, the primary and auxiliary mounting elements being laterally tapered toward their proximal ends, the adaptor aperture of the auxiliary mounting element being closer to its respective proximal end than its respective distal end.

9. A system as defined in claim 1 comprising a first and second said primary mounting element, each including at least two post apertures and a proximate end, the proximate ends each being tapered at an angle generally complimentary to the other.

10. A system as defined in claim 1 wherein the alignment detents are protrusions.

11. A system as defined in claim 1 wherein the alignment detents are holes or cavities.

12. A system as defined in claim 1 wherein two or more of the post apertures share the same alignment detent.

13. A system for mounting a multiplicity of tuning machines to a stringed musical instrument, the system comprising:

a mounting element including a multiplicity of post apertures and at least one alignment detent associated with each post aperture, the mounting element adapted to being placed in an assembled configuration with the instrument and a plurality of tuning machines, wherein in the assembled configuration:

(a) a string post of each tuning machine extends through a respective one of the post apertures and a respective head stock hole in the instrument;

(b) each string post is axially secured in its respective head stock hole without requiring penetration of the instrument independent of the head stock holes; and (c) the alignment detents substantially prevent rotational movement of a gear housing of each respective tuning machine with respect to the instrument.

14. A kit for mounting a multiplicity of tuning machines to a stringed musical instrument, the kit comprising:

a mounting element including a multiplicity of post apertures and at least one alignment detent associated with each post aperture; and a plurality of tuning machines, each tuning machine having a string post and a gear housing, each string post defining a post axis;

wherein the mounting element is adapted to being placed in an assembled configuration with the instrument and the tuning machines, such that:

(a) a string post of each tuning machine extends through a respective one of the post apertures and a respective head stock hole in the instrument;

(b) each string post is axially secured in its respective head stock hole without requiring penetration of the instrument independent of the head stock holes; and (c) the alignment detents substantially prevent rotational movement of each respective gear housing about its post axis with respect to the instrument.

15. A kit as defined in claim 14 wherein the alignment detents are protrusions.

16. A kit as defined in claim 14 wherein the alignment detents are holes or cavities.

17. A kit as defined in claim 14 wherein the mounting element includes a variety of detent elements associated with each post aperture.

18. A kit as defined in claim 17 wherein the variety of detent elements associated with each post aperture include both protrusions and holes.

19. A method for mounting a multiplicity of tuning machines to a stringed musical instrument, the method comprising the steps of:

selecting a mounting element including a multiplicity of post apertures and at least one alignment detent associated with each post aperture;

providing a plurality of tuning machines, each tuning machine having a string post and a gear housing, each string post defining a post axis;

inserting the post apertures of each tuning machine through a respective post aperture and a respective head stock hole in the instrument; and threadedly axially securing each string post in its respective head stock hole with the alignment detents engaging the respective gear housings and thereby substantially preventing rotational movement of the gear housings about their post axes with respect to the instrument.

20. The method as defined in claim 19, wherein neither the axial securement nor the prevention of rotational movement requires permanent alteration of the instrument from its originally-manufactured form.

* * * * *